US011260446B2

(12) United States Patent
Dong

(10) Patent No.: US 11,260,446 B2
(45) Date of Patent: Mar. 1, 2022

(54) FLOATING BLOCK OF HUB SHAPING MOLD AND HUB SHAPING MOLD HAVING SAME

(71) Applicants: NINGBO DEMA INTELLIGENT MACHINERY CO., LTD., Ningbo (CN); Xiangyi Dong, Ningbo (CN)

(72) Inventor: Xiangyi Dong, Ningbo (CN)

(73) Assignees: NINGBO DEMA INTELLIGENT MACHINERY CO., LTD., Ningbo (CN); Xiangyi Dong, Ningbo (CN)

( * ) Notice: Subject to any disclaimer, the term of this patent is extended or adjusted under 35 U.S.C. 154(b) by 0 days.

(21) Appl. No.: 16/600,569

(22) Filed: Oct. 14, 2019

(65) Prior Publication Data

US 2020/0038936 A1 Feb. 6, 2020

Related U.S. Application Data

(63) Continuation of application No. PCT/CN2018/090343, filed on Jun. 8, 2018.

(30) Foreign Application Priority Data

Jun. 8, 2017 (CN) ..... 201710427988.3
Jun. 8, 2017 (CN) ..... 201710428634.0
(Continued)

(51) Int. Cl.
*B21D 31/00* (2006.01)
*B21J 13/02* (2006.01)
(Continued)

(52) U.S. Cl.
CPC ..... *B21J 5/008* (2013.01); *B21D 31/005* (2013.01); *B21D 53/30* (2013.01); *B21K 1/38* (2013.01); *B21J 13/025* (2013.01)

(58) Field of Classification Search
CPC ..... B21D 53/30; B21D 31/005; B21D 22/14; B21D 22/18; B21J 13/025; B21J 5/12; B21J 5/008; B21K 1/38
See application file for complete search history.

(56) References Cited

U.S. PATENT DOCUMENTS 2,802,439 A 8/1957 Kay
3,129,496 A * 4/1964 Cox ..... B21D 53/264 29/894.324
2005/0050939 A1 3/2005 Woodward, Jr. et al.

FOREIGN PATENT DOCUMENTS

CN 101804435 A 8/2010
CN 104511536 Y 4/2015
(Continued)

OTHER PUBLICATIONS

EP 18814315 Search Report.
JP First Office Action.
International Search Report of PCT/CN2018/090343.

*Primary Examiner* — Gregory D Swiatocha

(57) ABSTRACT

The present disclosure provides a floating block of a hub shaping mold. The floating block can include: at least one inner support member having a first side and a second side opposite to each other, wherein the first side of the at least one inner support member can include a first arc surface, and at least one first bulge can be arranged on the first arc surface; at least one outer pressing member having a first side and a second side opposite to each other, wherein the first side of the at least one outer pressing member can include a second arc surface matched with the first arc surface, at least one second bulge can be arranged on the second arc surface, and the at least one first bulge and the at least one second bulge can be arranged in a staggered manner.

12 Claims, 8 Drawing Sheets

(30) Foreign Application Priority Data

| | | |
|---|---|---|
| Jun. 8, 2017 | (CN) | 201710429158.4 |
| Jun. 8, 2017 | (CN) | 201710429167.3 |
| Jun. 8, 2017 | (CN) | 201720661585.0 |
| Jun. 8, 2017 | (CN) | 201720661592.0 |
| Jun. 8, 2017 | (CN) | 201720662122.6 |

(51) Int. Cl.

| | |
|---|---|
| ***B21J 5/00*** | (2006.01) |
| ***B21D 53/30*** | (2006.01) |
| ***B21K 1/38*** | (2006.01) |

(56) References Cited

FOREIGN PATENT DOCUMENTS

| | | | | | |
|---|---|---|---|---|---|
| CN | 204247837 | U | | 4/2015 | |
| CN | 106994474 | A | | 8/2017 | |
| CN | 207386311 | U | | 5/2018 | |
| JP | 1999192804 | A | | 7/1999 | |
| JP | 2000280042 | A | | 10/2000 | |
| JP | 2002178075 | A | | 6/2002 | |
| WO | WO-2005014201 | A1 | * | 2/2005 | B60B 3/06 |

* cited by examiner

FLOATING BLOCK OF HUB SHAPING MOLD AND HUB SHAPING MOLD HAVING SAME

CROSS-REFERENCE TO RELATED APPLICATIONS

This application is a continuation of PCT patent application PCT/CN2018/090343 filed on Jun. 8, 2018, which claims all benefits accruing under 35 U.S.C. § 119 from China Patent Application Nos. 201710427988.3, filed on Jun. 8, 2017, 201710428634.0, filed on Jun. 8, 2017, 201710429158.4, filed on Jun. 8, 2017, 201710429167.3, filed on Jun. 8, 2017, 201720661585.0, filed on Jun. 8, 2017, 201720661592.0, filed on Jun. 8, 2017, and 201720662122.6, filed on Jun. 8, 2017, in the China National Intellectual Property Administration, the content of which is hereby incorporated by reference.

TECHNICAL FIELD

The present disclosure relates to the technical field of hub shaping, in particular to a floating block of a hub shaping mold and a hub shaping mold having the same.

BACKGROUND

In heat treatment, hub products usually have a large deformation. The deformation of the hub products can be eliminated in a mechanical cutting mode after the heat treatment to obtain the required size. However, the material consumption of the hub products is greatly increased, the cost is high, and the production efficiency is low.

SUMMARY

The present disclosure provides a floating block of a hub shaping mold and a hub shaping mold thereof.

The present disclosure provides the floating block of the hub shaping mold.

The floating block of the hub shaping mold can include: at least one inner support member having a first side and a second side opposite to each other, wherein the first side of the at least one inner support member can include a first arc surface, and at least one first bulge can be arranged on the first arc surface; at least one outer pressing member having a first side and a second side opposite to each other, wherein the first side of the at least one outer pressing member can include a second arc surface matched with the first arc surface, at least one second bulge can be arranged on the second arc surface, and the at least one first bulge and the at least one second bulge can be arranged in a staggered manner.

The present disclosure further includes a hub shaping mold.

The hub shaping mold for shaping a hub can include: a second driving mechanism; a first workbench, wherein a rotary disk can be arranged on the first workbench and connected with the second driving mechanism; a first die core, wherein the first die core can be arranged on the rotary disk, a positioning element can be arranged on the first die core, the first die core can be matched with the positioning element to fix a hub to be shaped; the at least one inner support member; a second workbench arranged above the first workbench, wherein a first driving mechanism can be disposed on the second workbench, the first driving mechanism can include an output shaft connected with a pressing block, the at least one inner support member can be connected with the pressing block, and the first driving mechanism can be configured for driving the pressing block to move so as to drive the at least one inner support member to move; a second die core arranged above the first die core, wherein the at least one inner support member can abut against the second die core; and the at least one outer pressing member.

The details of one or more embodiments of the present disclosure will be set forth in the accompanying drawings and description. Other features, objects, and advantages of the present disclosure will become apparent from the description, drawings, and claims.

BRIEF DESCRIPTION OF THE DRAWINGS

In order to better describe and illustrate embodiments and/or examples of the present disclosure, one or more drawings are provided. Additional details or examples for describing the drawings should not be considered to be limited by the scope of any of the best modes of the embodiments and/or examples of the present disclosure.

DETAILED DESCRIPTION

The present disclosure will be described in further detail with reference to the accompanying drawings and specific embodiments.

Figure 1:
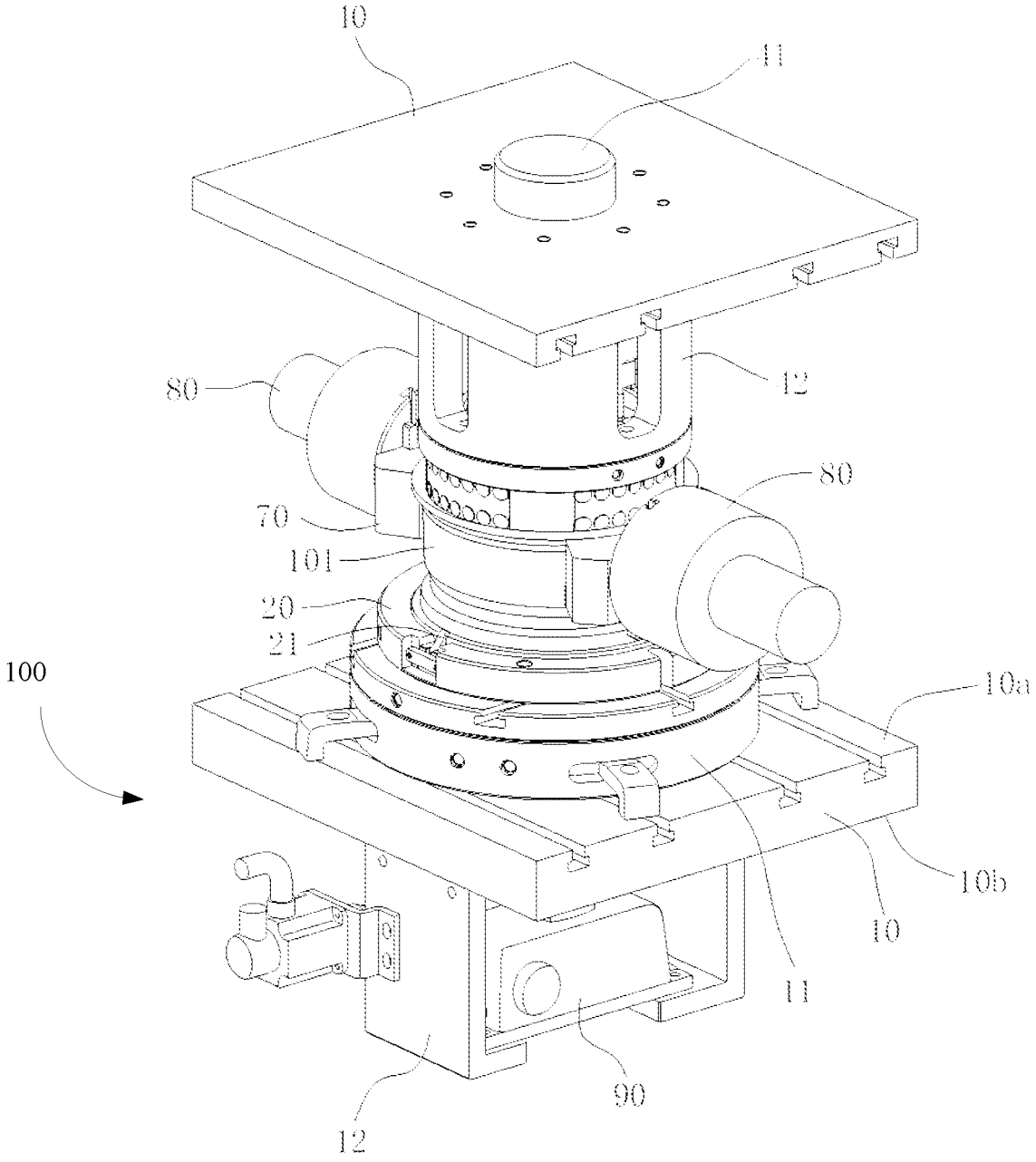
FIG. 1 is a perspective view of a hub shaping mold in one embodiment.

As shown in FIG. 1, the present disclosure provides a hub shaping mold 100. The hub shaping mold 100 is configured for shaping a hub 101. The hub 101 can include a lower surface and an upper surface, which are oppositely arranged. The hub 101 can further include an inner wall and an outer wall, which are oppositely arranged.

Figure 2:
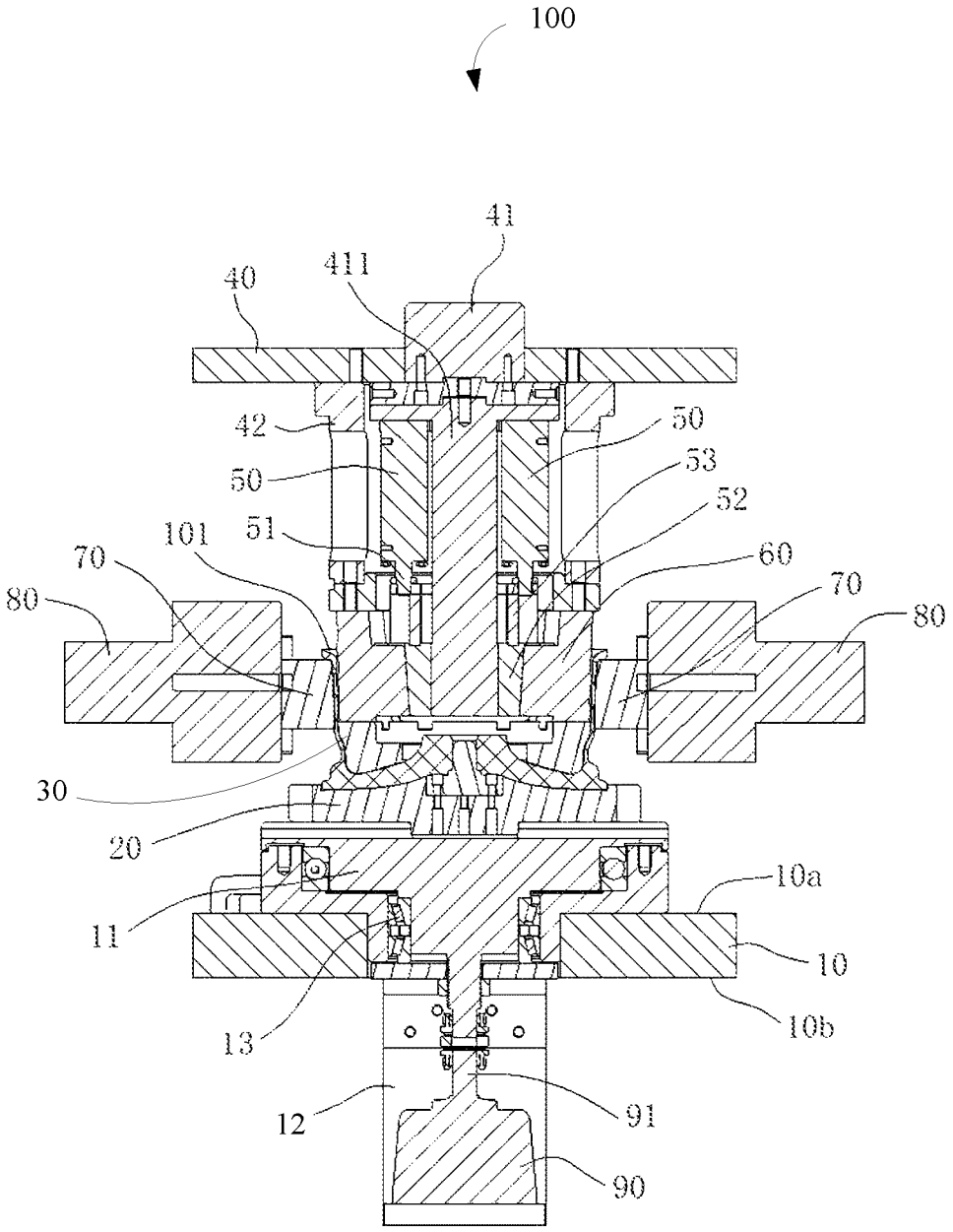
FIG. 2 is a cross-sectional view of a hub shaping mold in one embodiment.
Figure 3:
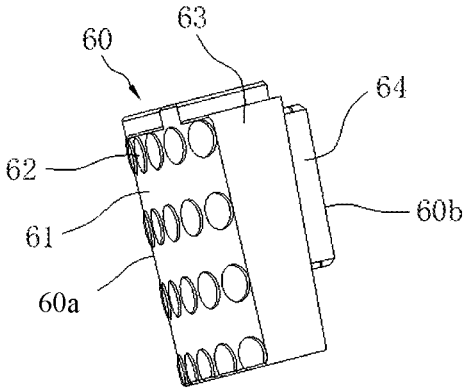
FIG. 3 is a perspective view of an inner support member in one embodiment.
Figure 4:
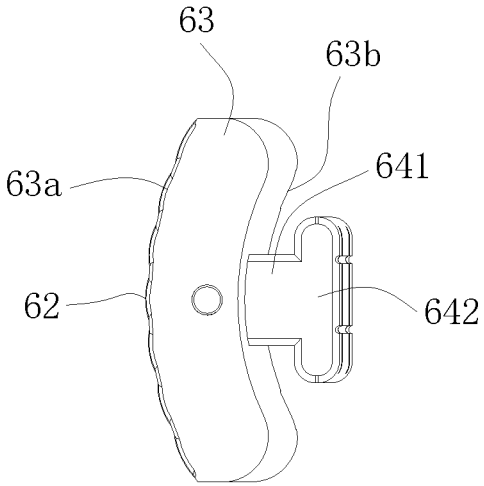
FIG. 4 is a top view of an inner support member in one embodiment.
Figure 5:
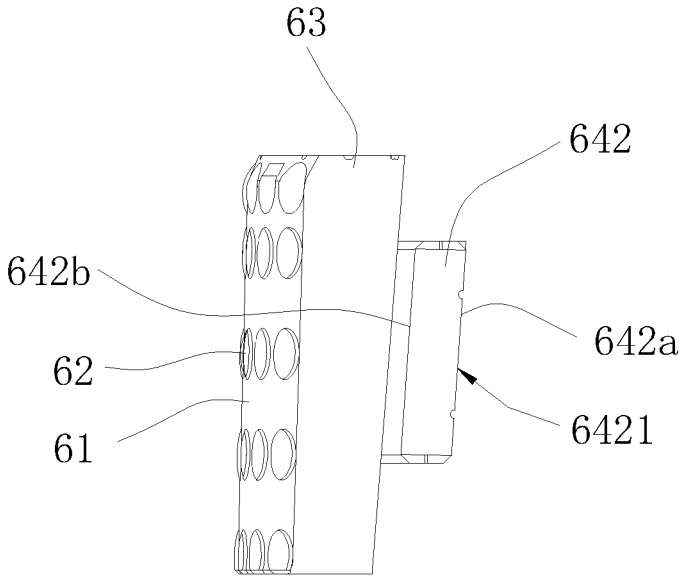
FIG. 5 is a front view of an inner support member in one embodiment.

Referring to FIG. 2, the hub shaping mold 100 can include a first workbench 10, a first die core 20, a second die core 30, a second workbench 40, a first driving mechanism 50, at least one inner support member 60, at least one outer pressing member 70, a third driving mechanism 80 and a second driving mechanism 90. The first die core 20 and the second die core 30 can be arranged between the first workbench 10 and the second workbench 40. The first driving mechanism 50 can be installed on the second workbench 40 and configured for driving the inner support member 60 to move. The third driving mechanism 80 can be configured for driving the outer pressing member 70 to move. The second driving mechanism 90 can be mounted on the first workbench 10.

The first workbench 10 can include an upper surface 10*a* and a lower surface 10*b* which can be oppositely arranged. A rotary disk 11 can be arranged on the upper surface 10*a* of the first workbench 10. A support 12 can be arranged on the lower surface 10*b* of the first workbench 10. The second driving mechanism 90 can be disposed on the support 12 and include a driving shaft 91. The driving shaft 91 can penetrate through the first workbench 10 and be fixedly connected with the rotary disk 11. The driving shaft 91 can be configured for driving the rotary disk 11 to rotate. A bearing 13 can be arranged between the rotary disk 11 and the first workbench 10. And a speed reducer can be also arranged between the second driving mechanism 90 and the rotary disk 11.

In one embodiment, the second driving mechanism 90 can be a servo motor or a common motor.

The first die core 20 can be fixed on the rotary disk 11. The first die core 20 can include an upper surface and a lower surface which are oppositely arranged. The lower surface of the first die core 20 can abut against the rotary disk 11, so that when the rotary disk 11 rotates, the first die core 20 can drive the hub 101 to rotate concentrically. The upper surface of the first die core 20 can be matched with the lower surface of the hub 101. A positioning element 21 can be arranged on the first die core 20. And the first die core 20 can be matched with the positioning element 21 to position and clamp the hub 101.

The second die core 30 can be arranged above the first die core 20. The inner support member 60 abuts against the second die core 30. The second die core 30 can include a lower surface and an upper surface which are oppositely arranged. The lower surface of the second die core 30 can be matched with the upper surface of the hub 101.

The second workbench 40 can be disposed above the first workbench 10. The first driving mechanism 50 can be installed on the second workbench 40. A fourth driving mechanism 41 and a die holder 42 can be arranged on the second workbench 40. A connecting column 411 can be arranged on the fourth driving mechanism 41. The die holder 42 can be sleeved around the connecting column 411. In one embodiment, the first driving mechanism 50 can be arranged in the die holder 42. The fourth driving mechanisms 41 can drive the connecting column 411 to move downwards, which can result in the hub 101 abutting against the first die core 20.

In one embodiment, the fourth driving mechanism 41 can be a plunger cylinder, an oil cylinder, or the like.

Figure 12:
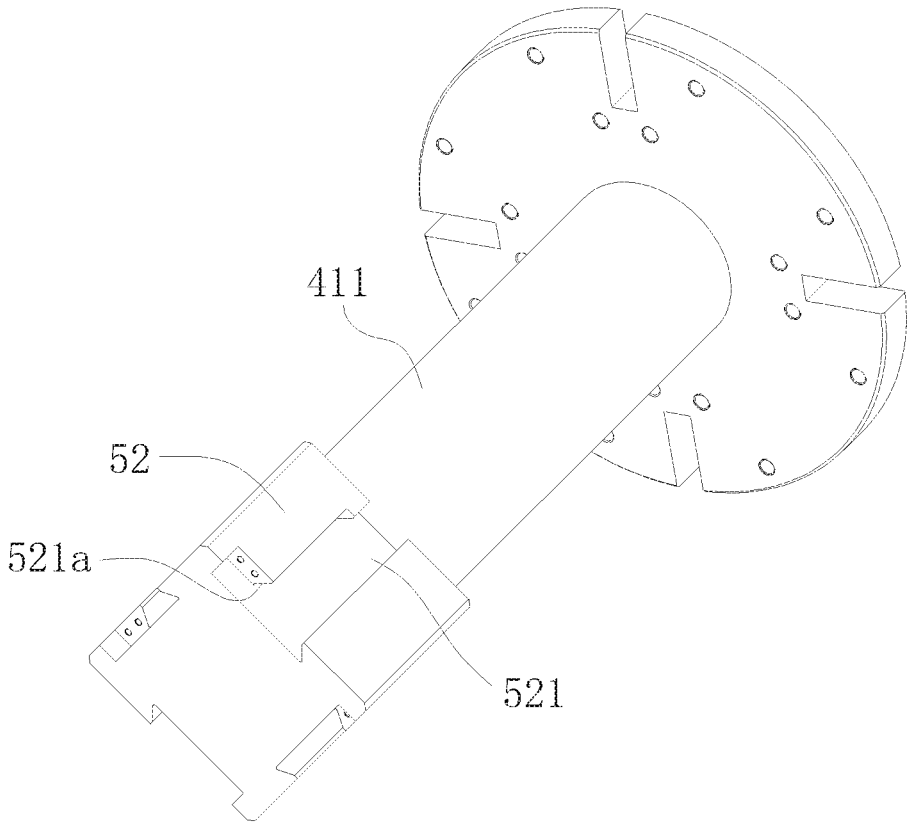
FIG. 12 is a perspective view of a connecting column and a pressing block in another embodiment.

The first driving mechanism 50 can include an output shaft 51. The output shaft 51 can be connected with a pressing block 52. The inner support member 60 can be connected with the pressing block 52. A connecting block 53 can be arranged on the output shaft 51. The pressing block 52 can be arranged on the connecting block 53. Referring to FIG. 12, a connecting groove 521 can be formed in the pressing block 52. The connecting groove 521 can include a first inclined surface 521*a*.

In this embodiment, the first driving mechanism 50 can drive the connecting block 53 to make the pressing block 52 move up and down. The first inclined surface 521*a* of the connecting groove 521 can be matched with the inner support member 60, so that a vertical movement of the pressing block 52 driven by the first driving mechanism 50 can be converted into a horizontal movement of the inner support member 60.

In one embodiment, the first driving mechanism 50 can be a servo motor or a common motor.

Referring to FIGS. 2 to 5, the inner support member 60 can be configured for shaping the inner wall of the hub 101. The number of the inner support members 60 can be one or more, e.g., the hub shaping mold 100 can include a plurality of inner support members 60. Each inner support member 60 can include a first side 60*a* and an oppositely arranged second side 60*b*. The first side 60*a* of the inner support member 60 can include a first arc surface 61. At least one first bulge 62 can be arranged on the first arc surface 61. A circular structure can be formed by the first arc surfaces 61 of the plurality of inner support members 60. In one embodiment, the first bulge 62 can be a point-shaped protrusion, and a plurality of first bulges 62 can be arranged on the first arc surface 61 in a rectangular array manner.

Each of the inner support members 60 can include a supporting plate 63 and a pushing block 64. The supporting plate 63 can include a first side 63*a* and a second side 63*b* opposite to each other. The first arc surface 61 can be located on the first side 63*a* of the supporting plate 63. The second side 63*b* of the supporting plate 63 can be connected with the pushing block 64.

A cross section of the pushing block 64 can be T-shaped. The pushing block 64 can include a first block 641 and a second block 642 connected with each other. The first block 641 can be arranged between the supporting plate 63 and the second block 642. In one embodiment, the first block 641 can be located on the second side 63*b* of the supporting plate 63 and connected with the supporting plate 63.

The second block 642 can include a first side 642*a* and a second side 642*b* opposite to each other. The first side 642*a* of the second block can be obliquely arranged towards the supporting plate 63 to form a second inclined surface 6421. The first inclined surface 521*a* of the connecting groove 521 and the second inclined surface 6421 can be matched with each other. The first driving mechanism 50 can drive the pressing block 52 to move so as to enable the first inclined surface 521*a* to touch and press the second inclined surface 6421, so that the vertical movement of the first driving mechanism 50 can be converted into the horizontal movement of the inner support member 60, and the inner support member 60 can extrude and shape the hub 101.

Figure 6:
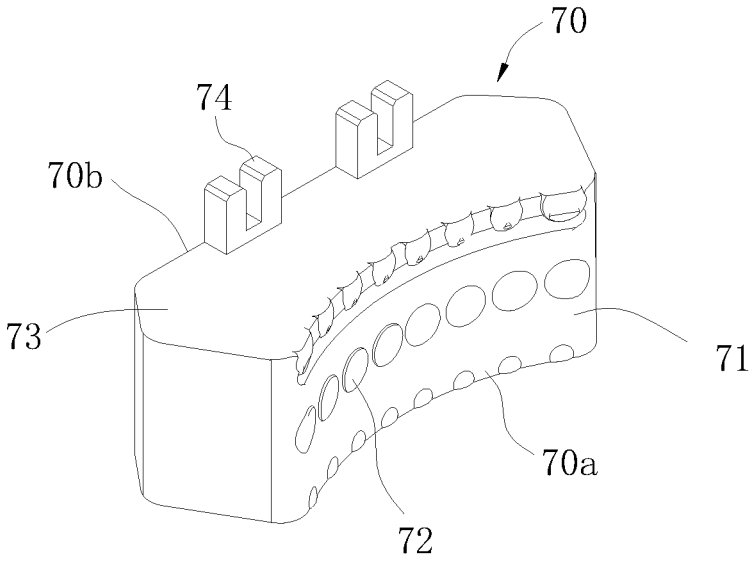
FIG. 6 is a perspective view of an outer pressing member in one embodiment.

Referring to FIG. 2 and FIG. 6, the outer pressing member 70 can be configured for shaping the outer wall of the hub 101. The number of the outer pressing members 70 can be one or more, e.g., the hub shaping mold 100 can include a plurality of outer pressing members 70. The number of the outer pressing members 70 can be matched with the number of the inner support members 60, that is, the outer pressing members 70 are corresponding to the inner support members 60 by one to one, and each outer pressing member 70 is opposite to the corresponding inner support member 60. The first driving mechanism 50 can drive the inner support member 60 to move and the third driving mechanism 80 drives the outer pressing member 70 to move, so that the inner support member 60 and the outer pressing member 70 can be close to each other, tightly pressed and attached to the inner wall and the outer wall of the hub 101. The first arc surface 61 of the inner support member 60 and the outer pressing member 70 can simultaneously generate a pressure toward the hub 101, so that a contour line can be formed on the hub 101 and the hub 101 can be shaped to a standard hub.

In one embodiment, the plurality of outer pressing members 70 can be formed to an annular structure matched with the circular structure formed by the first arc surfaces 61 of the inner support members 60.

Each of the outer pressing members 70 can have a first side 70*a* and a second side 70*b* opposite to each other. The first side 70*a* of the outer pressing member 70 can include a second arc surface 71 matched with the first arc surface 61. At least one second bulge 72 can be arranged on the second arc surface 71, for example, a plurality of second bulges 72 can be arranged on the second arc surface 71. The plurality of first bulges 62 and the plurality of second bulges 72 can be arranged in a staggered manner to improve the shaping effect.

Both the first arc surface 61 and the second arc surface 71 can be circular arc surfaces. The hub 101 can be rotated and shaped repeatedly, so that all directions of the hub 101 can be pressed by the first bulges 62 of the first arc surface 61 and the second bulges 72 of the second arc surface 71. The hub 101 can be shaped to be in a round shape and a standard size.

Figure 7:
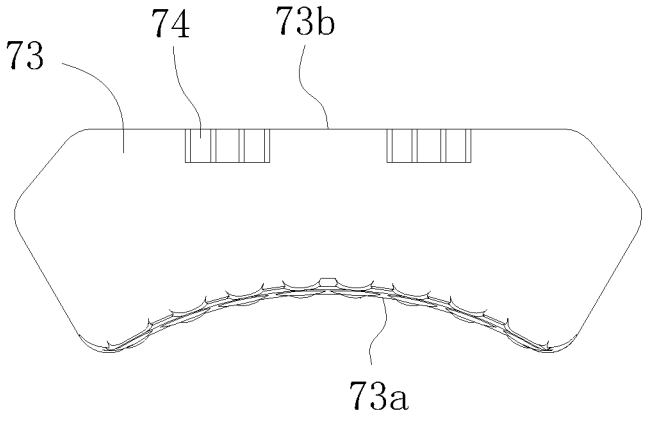
FIG. 7 is a front view of an outer pressing member in one embodiment.
Figure 8:
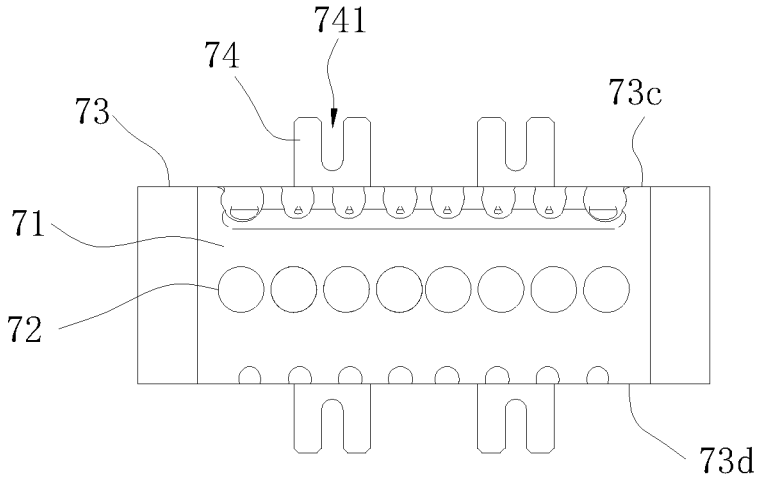
FIG. 8 is a top view of an outer pressing member in one embodiment.

Referring to FIGS. 6 to 8, in one embodiment, the second bulges 72 can be in a point shape. The outer pressing member 70 can be regarded as a point-like outer pressing member. The plurality of second bulges 72 and the plurality of first bulges 62 can be arranged in a staggered manner.

In this embodiment, each of the outer pressing members 70 can include a pressing plate 73 and a fixing block 74. The pressing plate 73 can include a first side 73*a* and a second side 73*b* opposite to each other. The second arc surface 71 can be located on the first side 73*a* of the pressing plate 73. The pressing plate 73 can further include a first end 73*c* and a second end 71*d* opposite to each other, and both the first end 73*c* and the second end 71*d* of the pressing plate can be connected with the fixing block 74.

The number of the fixing blocks 74 can be one or more. Each of the fixing blocks 74 can be in a U shape. An opening 741 can be formed in each fixing block 74 and away from the pressing plate 73. The fixing block 74 can be connected with the third driving mechanism 80. The pressing plate 73 can be driven to move by the third driving mechanism 80. In one embodiment, the number of the fixing blocks is four, and the four fixing blocks 74 are distributed on four corners of the outer pressing member 70, so that the outer pressing member 70 will not rotate, or move up and down in a moving process and dislocation can be avoided.

In one embodiment, the second bulges 72 can be arranged on the second arc surface 71 in a rectangular array manner. The second bulges 72 in each row can be in a staggered arrangement with the first bulges 62 in each row on the first arc surface 61, such that the first bulges 62 can abut against the second arc surface 71 while the second bulges 72 abut against the first arc surface 61. Therefore, when the inner support member 60 and the outer pressing member 70 clamp the hub 101, the first bulges 62 will abut against the inner wall of the hub 101 and the second bulges 72 will abut against the outer wall of the hub 101. In this way, a good clamping effect can be achieved through the staggered arrangement, and the shaping effect can be improved.

Figure 9:
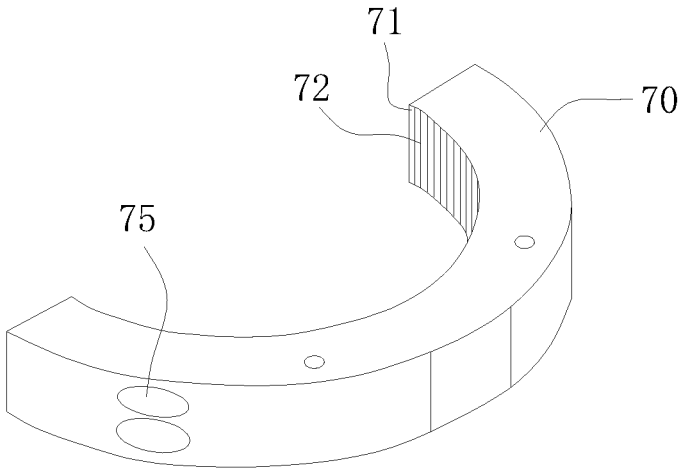
FIG. 9 is a perspective view of an outer pressing member in another embodiment.
Figure 10:
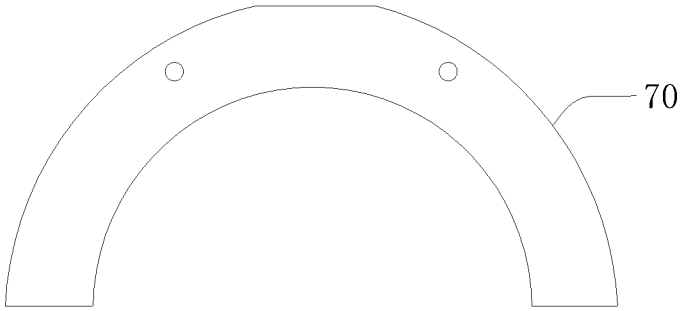
FIG. 10 is a front view of an outer pressing member in another embodiment.
Figure 11:
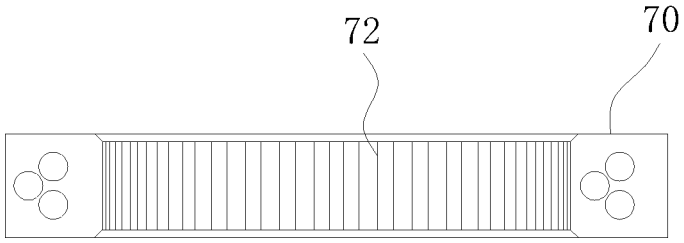
FIG. 11 is a top view of an outer pressing member in another embodiment.

Referring to FIGS. 9 to 11, in another embodiment, the second bulge 72 can be tooth-shaped protrusions. The outer pressing member 70 can be also regarded as a toothed outer pressing member. The tooth-shaped protrusions can be arranged along a circumferential direction of the second arc surface 71. The second bulges 72 in each row can be in staggered arrangement with the first bulges 62 in each row, such that the tooth-shaped protrusions can abut against the first arc surface 61 and the first bulges 62 can also abut against the second arc surface 71. Therefore, when the inner support member 60 and the outer pressing member 70 clamp the hub 101, the first bulges 62 will abut against the inner wall of the hub 101 and the second bulges 72 will abut against the outer wall of the hub 101. In this way, a good clamping effect can be achieved through the staggered arrangement and the shaping effect can be improved.

In this embodiment, the outer pressing member 70 can be in a semi-annulus shape. A plurality of bolt holes 75 can be formed in the outer pressing member 70 and configured for connecting the outer pressing member 70 with the third driving mechanism 80. The number of the bolt holes 75 can be four. The four bolt holes 75 can be distributed on four corners of the outer pressing member 70, so that the outer pressing member 70 will not rotate or move up and down in the moving process and dislocation can be avoided.

In this embodiment, the number of the outer pressing members 70 can be two. The two outer pressing members 70 can form the annular structure.

The third driving mechanism 80 can be a servo motor or a common motor.

Figure 13:
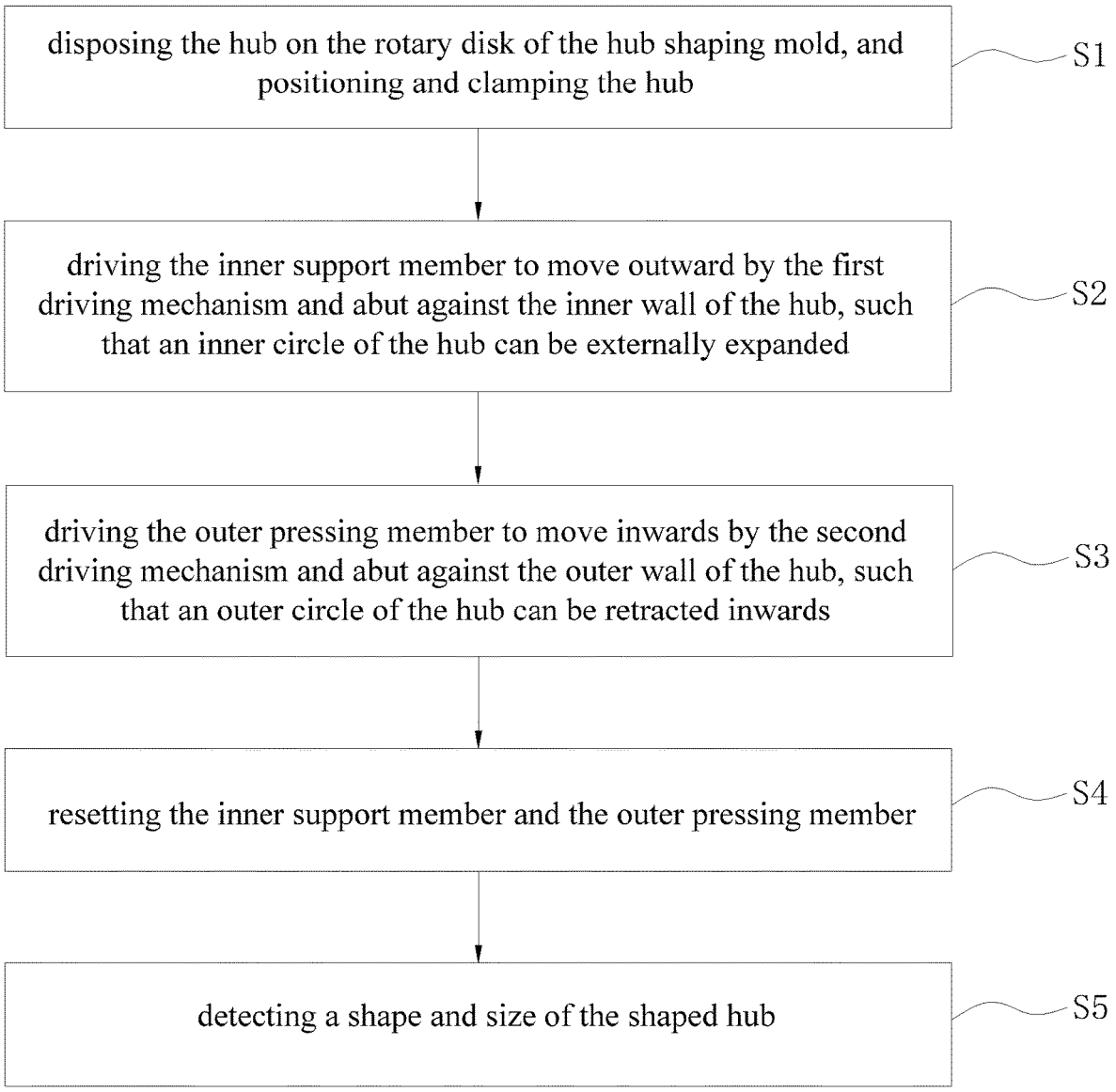
FIG. 13 is a flow chart of a method for shaping a hub in one embodiment.

Referring to FIG. 13, the present disclosure further provides a hub shaping method. The hub shaping method can be taken by the hub shaping mold 100. The hub shaping mold 100 can include the rotating disk 11, the first die core 20, the positioning element 21, the inner support member 60, the first driving mechanism 50, the outer pressing member 70, the third driving mechanism 80 and the like. The hub shaping method can include the following steps.

Step S1, disposing the hub 101 on the rotary disk 11 of the hub shaping mold 100, and positioning and clamping the hub 101;

Step S2, driving the inner support member 60 to move outward by the first driving mechanism 50 and abut against the inner wall of the hub 101, such that an inner circle of the hub 101 can be externally expanded;

Step S3, driving the outer pressing member 70 to move inwards by the third driving mechanism 80 and abut against the outer wall of the hub 101, such that an outer circle of the hub 101 can be retracted inwards;

Step S4, resetting the inner support member 60 and the outer pressing member 70, that is, separating the inner support member 60 and the outer pressing member 70 from the hub 101, so that the hub 101 can be freely rotated or taken out;

Step S5, detecting a shape and size of the shaped hub, and determining whether the shape and the size of the shaped hub, if the shape and the size of the shaped hub are up to standard, the shaping ends; if not, the step S1 to the step S4 will be repeated until the shape and the size of the shaped hub are up to standard.

In the step S1 of disposing the hub 101 on the rotary disk 11 of the hub shaping mold 100, and positioning and clamping the hub 101, an angle of the hub 101 can be adjusted, and the hub 101 can be positioned and clamped by the first die core 20 and the positioning element 21.

The step S4 of resetting the inner support member 60 and the outer pressing member 70 can include the following steps:

Step S41, rotating the rotary disk 11 in order to make the hub 101 rotate and repeating the steps S1 to S3, until both the inner wall and the outer wall of the hub 101 are shaped by the inner support member 60 and the outer pressing member 70.

The step S5 of detecting the shape and size of the shaped hub can include the following steps:

Step S51, detecting the shape and the size of the shaped hub 101, and adjusting the angle of the hub 101, such that a part of the hub 101 to be shaped (e.g. a recessed or bumped part) can be arranged between the inner support member 60 and the outer pressing member 70 as far as possible.

By the hub shaping method, a utilization rate of materials of the hub products can be reduced by 1 kg-3 kg, an overall cost can be reduced by 10%-20%, and the productivity can be greatly improved. That is, the shaping mold has a great advantage on shaping the hub.

It should be understood that although the steps in the flow chart of FIG. 13 can be displayed in sequence according to the indication of the arrows, the steps may not be necessarily sequentially performed in the order indicated by the arrows. Unless explicitly stated herein, the execution of these steps may not be strictly limited in order, but may be performed in other sequences. Further, at least one of the steps in FIG. 13 may include a plurality of sub-steps or stages, which may not be necessarily performed at the same time, but can be executed at different times. The execution sequence may not be necessarily performed in sequence, and at least a part of the sub-steps or phases of other steps or other steps can be executed in turn or alternatively.

The technical features of the above embodiments can be arbitrarily combined, and all possible combinations of all technical features in the embodiments can be described for simplicity of description. However, as long as the combination of the technical features does not conflict, it should be considered within the scope of the present disclosure.

The above embodiments only express several embodiments of the present disclosure, and the description can be specific and detailed, but cannot be construed as a limitation on the scope of the present disclosure. It should be noted that many modifications and improvements can be made to persons of ordinary skill in the art without departing from the concept of the present disclosure, and all the materials belong to the protection scope of the present disclosure. Therefore, the protection scope of the present disclosure can be subject to the appended claims.

I claim:

1. A hub shaping mold for shaping a hub, comprising:

a second driving mechanism;

a first workbench;

a rotary disk arranged on the first workbench and connected with the second driving mechanism;

a first die core arranged on the rotary disk;

a positioning element arranged on the first die core, wherein the first die core is attached to the positioning element to fix a hub to be shaped;

a plurality of inner support members and a plurality of outer pressing members;

a second workbench arranged above the first workbench, wherein a first driving mechanism is disposed on the second workbench, the first driving mechanism comprises an output shaft connected with a pressing block, the plurality of inner support members are connected with the pressing block, and the first driving mechanism is configured for driving the pressing block to move so as to drive the plurality of inner support members to move; and a second die core arranged above the first die core, wherein the plurality of inner support members abut against the second die core, wherein each of the plurality of inner support members has a first side and a second side opposite to each other, wherein the first side of each of the plurality of the inner support members comprises a first arc surface, and at least one first bulge is arranged on the first arc surface;

each of the plurality of outer pressing members has a first side and a second side opposite to each other, wherein the first side of each of the plurality of outer pressing members comprises a second arc surface facing a corresponding first arc surface of the plurality of inner support members, at least one second bulge is arranged on the second arc surface, and the at least one first bulge and the at least one second bulge are arranged in a staggered manner and configured for clamping the hub.

2. The hub shaping mold of claim 1, wherein a connecting groove is formed in the pressing block, and a pushing block is located in the connecting groove, such that the first driving mechanism can drive the plurality of inner support members to move.

3. The hub shaping mold of claim 2, wherein the connecting groove comprises a first inclined surface, the pushing block comprises a second inclined surface;

the first inclined surface and the second inclined surface contact each other; and the first driving mechanism is configured for driving the pressing block to move so as to enable the first inclined surface to touch and press the second inclined surface, realizing a movement of the plurality of inner support members.

4. The hub shaping mold of claim 3, wherein the output shaft of the first driving mechanism is provided with a connecting block, the pressing block is connected with the connecting block, and the output shaft is configured for driving the connecting block to move, resulting in driving the pressing block to move and realize the movement of the plurality of inner support members.

5. The hub shaping mold of claim 1, wherein the second workbench is provided with a die holder and a fourth driving mechanism, the fourth driving mechanism comprises a connecting column, and the first driving mechanism is arranged between the die holder and the connecting column.

6. The hub shaping mold of claim 1, wherein the first workbench is provided with a support, the second driving mechanism is fixed on the support and comprises a driving shaft, and the driving shaft is connected with the rotary disk and configured for driving the rotary disk to rotate.

7. The hub shaping mold of claim 1, wherein further comprising a third driving mechanism connected with the plurality of outer pressing members, the first driving mechanism and the third driving mechanism are configured for driving the plurality of inner support members and the plurality of outer pressing members to move close to the hub to be shaped or separating the plurality of inner support members and the plurality of pressing members away from the hub to be shaped.

8. The hub shaping mold of claim 1, wherein each of the plurality of inner support member comprises a supporting plate and a pushing block, the supporting plate has a first side and a second side opposite to each other, the first arc surface is located on the first side of the supporting plate, and the second side of the supporting plate is connected with the pushing block.

9. The hub shaping mold of claim 8, wherein a cross section of the pushing block is T-shaped, the pushing block comprises a first block and a second block connected with the first block.

10. The hub shaping mold of claim 8, wherein the plurality of inner support members are encircled to form a circular structure.

11. The hub shaping mold of claim 10, wherein the plurality of outer pressing members are encircled to form an annular structure around the circular structure.

12. The hub shaping mold of claim 1, wherein each of the plurality of outer pressing members comprises a pressing plate and a fixing block, wherein the pressing plate comprises a first side and a second side opposite to each other, the second arc surface is located on the first side of the pressing plate, the pressing plate is provided with a first end and a second end opposite to each other, and both the first end and the second end of the pressing plate are connected with the fixing block.

* * * * *